United States Patent [19]

Linard

[11] 3,938,203

[45] Feb. 17, 1976

[54] PATIENT-LIFTER

[75] Inventor: Robert Linard, Nancy, France

[73] Assignee: Societe Anonyme dite: SETIM Societe d'Etudes Techniques des Industries Metallurgiques, France

[22] Filed: Nov. 1, 1974

[21] Appl. No.: 520,351

[30] Foreign Application Priority Data

Nov. 5, 1973 France ..... 73.40209

[52] U.S. Cl. ..... 5/81 R; 5/86

[51] Int. Cl.[2] ..... A47B 83/04

[58] Field of Search ..... 5/81 R, 81 B, 82, 86

[56] References Cited

UNITED STATES PATENTS

| | | | |
|---|---|---|---|
| 3,493,979 | 2/1970 | Koll et al. | 5/81 B |
| 3,724,005 | 4/1973 | Stevens | 5/81 R |
| 3,760,435 | 9/1973 | Jardine | 5/81 R |
| 3,769,642 | 11/1973 | Warman | 5/81 R |

*Primary Examiner*—Casmir A. Nunberg
*Attorney, Agent, or Firm*—Robert E. Burns; Emmanuel J. Lobato; Bruce L. Adams

[57] ABSTRACT

A patient-lifting stretcher comprises a movable flexible frame formed of two closed longitudinal slideways between which there are movably mounted two parallel support sheets staggered with respect to each other which have one end in common provided with a reversing roller and two separate ends each having a reversing roller. Over these rollers and sheets there slide two cloths whose common end is connected to a fixed point and whose other ends, after passing over the rollers, are each firmly connected with a separate fixed point so that when the stretcher is displaced, one of the cloths moves under the body of the patient while the other, below this one, moves over the mattress or other surface which has until then directly sustained the body.

9 Claims, 6 Drawing Figures

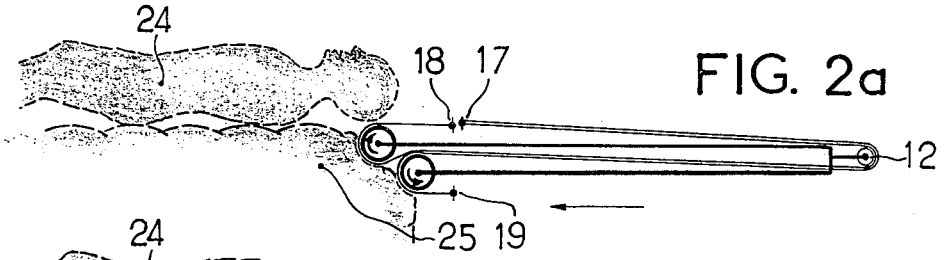
FIG. 2a
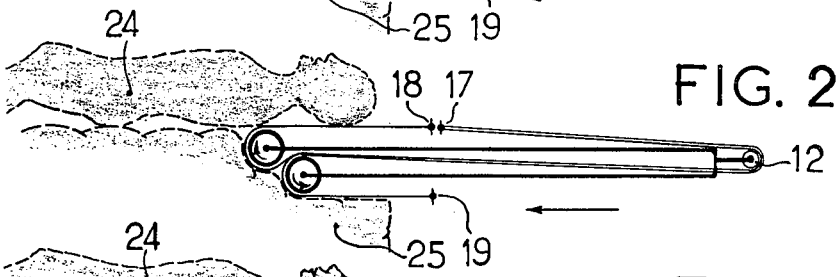
FIG. 2b
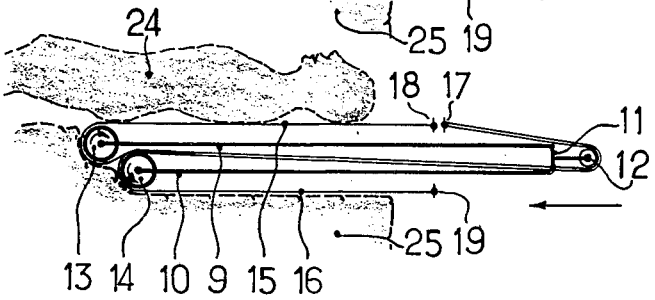
FIG. 2c
FIG. 3
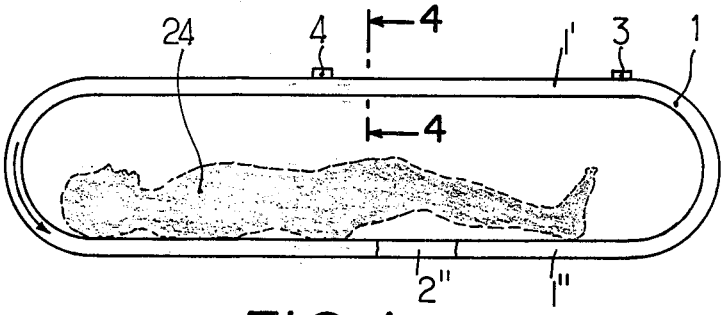
FIG. 4
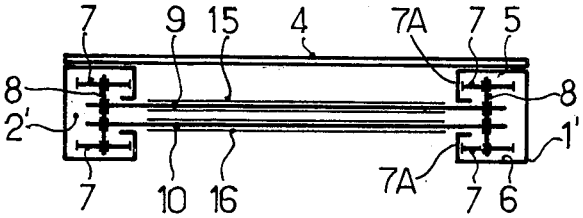

PATIENT-LIFTER

BACKGROUND OF THE INVENTION

The present invention relates to a patient-lifter intended more particularly for the easy jolt-free handling of severely ill or injured patients.

The handling of severely ill or injured patients is still unfortunately effected manually in many cases by means of the arms of the stretcher bearers or nurses and by means of stretchers.

More and more the task of nursing is being entrusted to female personnel, both in hospitals and clinics. It follows from this that there is a very great need for systems and devices which assure said handling with a minimum amount of effort.

Certain embodiments have been devised. All of them present substantial difficulties in use, which difficulties for all practical purposes fully eliminate the attraction of the device as well as the benefit of the services which it might render.

For the reasons set forth above, these devices are disregarded in favor of the conventional methods of lifting which require additional personnel.

SUMMARY OF THE INVENTION

The object of the present invention is to do away with these drawbacks and it proposes a handling apparatus for patients who are ill or injured or handicapped, and in particular a patient-lifter which is characterized by the fact that it comprises a movable, flexible framework formed of two closed longitudinal slideways between which there are movably mounted two parallel support sheets staggered with respect to each other and having one end in common which is provided with a reversing roller and two distinct ends, each having a reversing roller and by the fact that on these rollers and sheets there slide two cloths whose common end is connected to a fixed point while the other ends thereof, after passage over the rollers, are each secured to a fixed point. The arrangement is such that when the stretcher is displaced one of the cloths moves under the body of the patient while the other, below this one moves over the mattress or other surface which until then has provided substantially direct support for the body.

The apparatus in accordance with the invention has numerous advantages:

it does considerable service and permits the handling of patients without the exertion of any manual effort;

its handling movements and more particularly the placing of the cloth under the patient are effected with the greatest gentleness, resulting in use which is more particularly suitable for patients who are seriously ill, have had highway accidents, etc.;

its price is moderate;

its weight, in the "aluminum" version enables it to be used by everyone;

if the apparatus is mounted on an elevator and the assembly motorized, a single person can handle the patient or he can even handle himself.

Other advantages will result from the use of this apparatus in hospital surroundings and numerous ones have already been contemplated.

BRIEF DESCRIPTION OF THE DRAWINGS

The invention will be better understood by reference to the following description and the accompanying drawing in which

FIGS. 2*a*, 2*b* and 2*c* are schematic views illustrating the passage of the cloth below the patient in such apparatus FIG. 3 is a schematic side view of the apparatus with the patient in position; and FIG. 4 is a schematic sectional view, taken along lines 4-4 in FIG. 3 of the top final part showing the position of the roller in the slideways.

Figure 1:
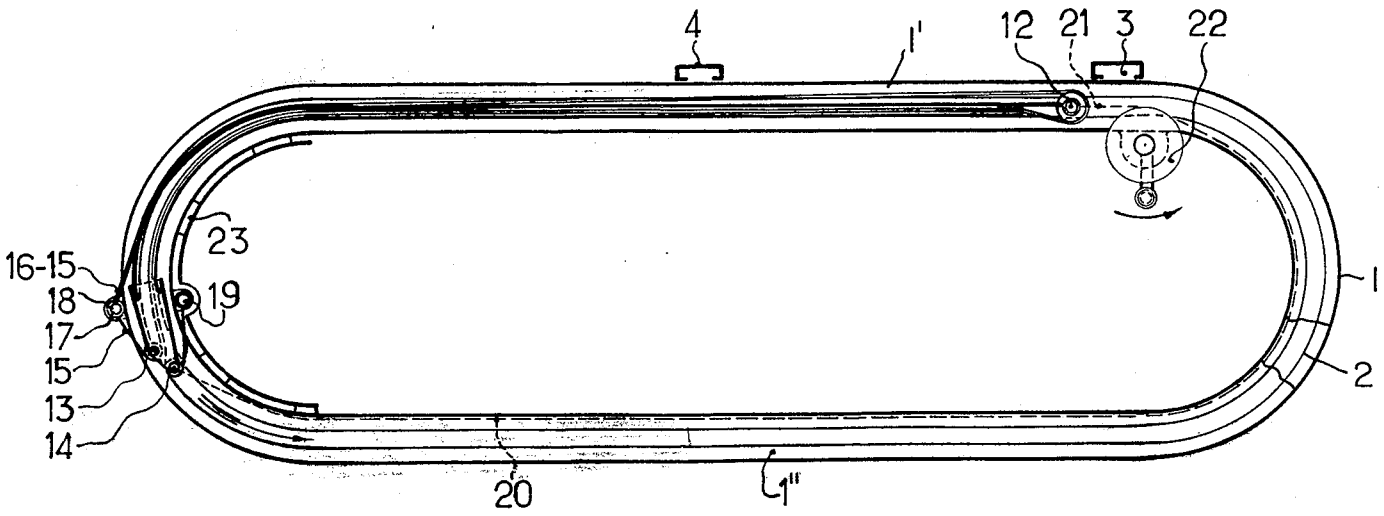
FIG. 1 is a side elevation of apparatus according to the invention.

Let us first of all refer to FIGS. 1, 3 and 4.

The patient-lifting device in accordance with the invention is composed of a movable, flexible framework formed of two closed longitudinal slideways 1 and 2, each having in side view a contour similar to the plan view of a racetrack and, both being arranged parallel to each other on opposite sides of the patient. These slideways are connected together by cross members 3 and 4, one of which is substantially, although schematically, shown in FIG. 4 and both of which may interconnect upper parts 1′,2′ of slideways 1,2 as shown in FIGS. 1, 3 and 4. Grasping members or lifting heads can engage in the cross members. The assembly forms a litter.

Each slideway has in cross section the shape of a U lying on its side and almost closed, as can be noted from FIG. 4.

Each slideway has an outer track, shown in FIG. 4 as the upper track 5, and an inner track, shown in FIG. 4 as the lower track 6. Rollers 7 move on these tracks and particularly, as shown in FIG. 4, the rollers roll on extension members 7A which extend toward one another from the free ends of the arms of the U-shaped cross-section of the slideway. These rollers are borne by a common shaft 8. It passes through and is thereby secured to a side edge of a first support sheet 9 at one place and of a second support sheet 10 at another place slightly staggered from the first, this occurring at regular intervals. When disposed on the lower parts 1″, 2″ of the slideways for supporting a patient, as shown in FIGS. 2*a*, 2*b*, 2*c* and 3, th first support sheet 9 is the upper one and the second, 10, is the lower one. They will be so identified hereinafter.

Let us refer furthermore to FIGS. 2*a*, 2 *b* and 2 *c*.

The two sheets are parallel and connected together at one of their ends by a common end piece 11 bearing a reversing roller 12 which also serves as tensioning roller. At the other ends the said sheets bear a roller 13 and 14 respectively. The lower roller 14 is staggered backward with respect to the upper roller by a distance equal to the stagger between the sheets at the level of passage of a shaft such as 8.

The support sheets 9 and 10 are preferably made of synthetic materials with slippery faces such as the materials known under the names of nylon and teflon. They are each covered on both faces by a cloth, namely the upper cloth 15 covers both faces of sheet 9 and the lower cloth 16 covers both faces of sheet 10, the terms "upper" and "lower" referring again to the locations of these elements as shown in FIG. 2*c;* also see FIG. 4. Two ends of these cloths are common and connected to a fixed point 17. The two cloths extend longitudinally beyond their respective support sheets, as shown in FIGS. 2*a*, 2*b* and 2*c*. As also shown, both of them pass in superimposed condition from point 17 over the reversing roller 12; they continue, still superimposed, below the upper sheet 9; and then move apart towards the two rollers 13 and 14 respectively each of which serves as guide directing the respective cloth 15, 16 towards a fixed upper point 18 and a fixed lower point 19.

As shown in FIGS. 1 and 4 the support sheets 9 and 10 and the cloths 15 and 16 are laterally stretched between the two slideways 1 and 2. As indicated by FIGS. 1, 2*a* 2*b* and 2*c* the end points 17, 18, 19 of cloths 15, 16 are secured to framework 1 to 4.

The assembly 7 to 16 described above, which constitutes the stretcher, is pulled longitudinally, underneath the patient by means of two pull chains 20 and 21 actuated by a winch 22 and concealed within the profiles of the longitudinal members 1, 2. On the curve placed on the path of the stretcher there is provided a guide 23 to impart to the stretcher a curved path which its tensioning would transform into a chord.

The operation of the assembly is as follows:

The litter is comprising the flexable framework 1, 2, 3, 4 is placed above a patient 24, the stretcher 1 to 16 then occupying the upper portion of the slide-ways 1, 2. This putting in place may be effected manually or mechanically by means of a lift truck. By acting on the winch 22, the stretcher moves until then has substantially directly supported and one of the cloths 15 moves below the body of the patient while the other 16 moves over the means which until then has substantially directly supported the body, for instance a mattress 25, so that the relative displacement of the cloths with respect to the body and its support is zero.

The front parts of the stretcher, that is to say the rollers 13 an 14, impress a slight depression in the mattress equal to the thickness of the stretcher so that the sliding of the stretcher is imperceptible to the patient.

At the end of the path, the stretcher is below the patient and supports him, primarily by cloth 15. Together with framework 1–4 and stretcher 7 to 16 he can then be transported easily, either manually or by means of a lift and a carriage.

The reverse movement makes it possible to deposit the patient on another support under the same conditions.

Although the invention has been described with respect to a specific embodiment it is clear that it is in no way limited hereto and that various changes in form, materials and combinations can be made therein without thereby going beyond the scope or spirit of the invention.

I claim:

1. Apparatus for supporting and transferring a patient, comprising:

a framework comprising a pair of closed slideway tracks, said tracks being laterally spaced apart and being disposed in parallel generally vertical planes for positioning the tracks in stationary condition on sides of a flat support surface for a patient, the tracks having upper and lower, normally horizontal track portions and having a terminal track portion interconnecting ends of the horizontal track portions; and flexible stretcher means disposed to be guided by said track portions for positioning the flexible stretcher means, along said lower track portion, between the support surface and the patient to transfer the patient onto and from the flexible stretcher means.

2. Apparatus according to claim 1, in which the framework includes cross members interconnecting said upper track portions.

3. Apparatus according to claim 1, wherein each track has a generally U-shaped cross-sectional configuration the arms of which face laterally, each track including members extending toward one another from said arms; and the flexible stretcher means including roller means comprising pairs of horizontal rollers rolling respectively on said members, and a common vertical shaft supported by the rollers of each pair to support edge portions of the flexible stretcher means.

4. Apparatus according to claim 3 in which said flexible stretcher means comprises; a first support sheet having an edge portion supported by one of said shafts; and a second support sheet generally coextensive with the first and having an edge portion supported by another of said shafts.

5. Apparatus according to claim 4, in which said flexible stretcher means includes sheets of cloth, overlying opposite surfaces of each support sheet and longitudinally extending beyond the same.

6. Apparatus according to claim 5 in which said support sheets are interconnected at one of their ends; the roller means including cloth-reversing roller means supported by the interconnected ends and two additional roller means, each supported by said edge portion of one of said sheets and one being staggered with respect to the other, and said sheets of cloth having longitudinal ends secured to said framework.

7. Apparatus according to claim 5, in which said support sheets have slippery surfaces.

8. Apparatus according to claim 1, including a pair of pull chains, one on each slideway track, for moving end portions of the flexible stretcher means along the tracks; and a winch on the framework, disposed to move the chains for the moving of the end portions of the flexible stretcher means.

9. Apparatus according to claim 1, in which said terminal track portion is curved and is disposed to guide the flexible stretcher means in a correspondingly curved path.

* * * * *